US012209824B2

(12) United States Patent
De Herdt

(10) Patent No.: US 12,209,824 B2
(45) Date of Patent: Jan. 28, 2025

(54) HEAT EXCHANGER AND METHOD FOR MANUFACTURING SUCH A HEAT EXCHANGER

(71) Applicant: ATLAS COPCO AIRPOWER, NAAMLOZE VENNOOTSCHAP, Wilrijk (BE)

(72) Inventor: Johan De Herdt, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 216 days.

(21) Appl. No.: 18/012,764

(22) PCT Filed: Jun. 7, 2021

(86) PCT No.: PCT/IB2021/054967
§ 371 (c)(1),
(2) Date: Dec. 23, 2022

(87) PCT Pub. No.: WO2021/260465
PCT Pub. Date: Dec. 30, 2021

(65) Prior Publication Data

US 2023/0266077 A1 Aug. 24, 2023

(30) Foreign Application Priority Data

Jun. 26, 2020 (BE) ..... 2020/5476

(51) Int. Cl.
*F28F 9/02* (2006.01)
*F28D 9/00* (2006.01)
(Continued)

(52) U.S. Cl.
CPC ..... *F28F 9/0265* (2013.01); *F28D 9/0031* (2013.01); *F28F 9/001* (2013.01); *F28D 2021/0038* (2013.01)

(58) Field of Classification Search
CPC ..... F28F 9/0265; F28F 9/001; F28D 9/0031; F28D 2021/0038
(Continued)

(56) References Cited

U.S. PATENT DOCUMENTS 7,521,029 B2 * 4/2009 Guetlhuber ..... F28F 9/0229 422/198
8,376,029 B2 * 2/2013 Rericha ..... F28D 1/022 165/44
(Continued)

FOREIGN PATENT DOCUMENTS

CN 2071778 U 2/1991
CN 102967170 A 3/2013
(Continued)

OTHER PUBLICATIONS

International Search Report of PCT/IB2021/054967 dated Aug. 26, 2021 [PCT/ISA/210].
(Continued)

*Primary Examiner* — Joel M Attey
(74) *Attorney, Agent, or Firm* — Sughrue Mion, PLLC

(57) ABSTRACT

A heat exchanger with a housing (3) that contains a set of channels (12); an inlet collector (4) having an inlet collector chamber (9) with an inlet (5), wherein the inlet collector chamber (9) includes first flow distribution means (10) configured to distribute a flow originating from the inlet (5) evenly over the set of channels (12); and an outlet collector (6). The first flow-rate distribution means (10) consist of a single body (15) that comprises two flow-conducting surfaces (16), which are symmetrical with respect to each other according to the first plane of symmetry and the second plane of symmetry, and which two flow-conducting surfaces (16), as seen from the inlet (5), are inclined downward in a first direction perpendicular to the first plane of symmetry
(Continued)

and/or in a second direction perpendicular to the second plane of symmetry.

15 Claims, 11 Drawing Sheets

(51) Int. Cl.
*F28F 9/00* (2006.01)
*F28D 21/00* (2006.01)

(58) Field of Classification Search
USPC ..... 165/159
See application file for complete search history.

(56) References Cited

U.S. PATENT DOCUMENTS

| | | | | |
|---|---|---|---|---|
| 10,553,322 | B2 * | 2/2020 | Hosseini | F28B 9/02 |
| 2010/0032146 | A1 * | 2/2010 | Hartung | F28F 9/0263 165/172 |

FOREIGN PATENT DOCUMENTS

| | | | |
|---|---|---|---|
| CN | 103063076 | A | 4/2013 |
| CN | 106989629 | A | 7/2017 |
| CN | 207456261 | U | 6/2018 |
| CN | 109780925 | A | 5/2019 |
| EP | 0230940 | A2 | 8/1987 |
| KR | 100665895 | B1 | 1/2007 |
| SU | 877309 | A1 | 10/1981 |

OTHER PUBLICATIONS

Written Opinion of PCT/IB2021/054967 dated Aug. 26, 2021 [PCT/ISA/237].
Written Opinion of the International Preliminary Examining Authority of PCT/IB2021/054967 dated Nov. 26, 2021 [PCT/IPEA/408].
International Preliminary Report on Patentability of PCT/IB2021/054967 dated Jan. 31, 2022 [PCT/IPEA/409].

* cited by examiner

HEAT EXCHANGER AND METHOD FOR MANUFACTURING SUCH A HEAT EXCHANGER

CROSS REFERENCE TO RELATED APPLICATIONS

This application is a National Stage of International Application No. PCT/IB2021/054967 filed on Jun. 7, 2021, claiming priority based on Belgium Patent Application No. 2020/5476 filed on Jun. 26, 2020.

The present invention relates to a heat exchanger and a method for manufacturing such a heat exchanger.

More specifically, the invention relates to a heat exchanger for exchanging heat between two fluids, respectively a first initially two-phase fluid and a second fluid, where the heat exchanger comprises a set of channels and further comprises an inlet collector having an inlet for the first initially two-phase fluid and an inlet collector chamber, which inlet collector chamber contains first flow-rate distribution means to distribute a flow of the first initially two-phase fluid originating from the inlet evenly across the set of channels.

By "a first initially two-phase fluid", in the context of the invention, is meant that said first fluid is a two-phase mixture of gas or vapour on the one hand and liquid on the other hand before the exchange of heat with the second fluid occurs.

In such a heat exchanger, heat is exchanged between the two fluids, where the first initially two-phase fluid flows through the channels from an inlet collector to an outlet collector, while the second fluid flows outside along said channels within a housing.

Such heat exchangers are used, for example, in a refrigeration dryer for the cooling and drying of compressed gas from a compressor installation, such as compressed air. In this case, the compressed gas in the housing is conducted around the channels, while a cooling agent is directed into the channels.

Cool drying is based on the principle that when a temperature of the compressed gas is lowered, this compressed gas is dried by condensation of moisture from the compressed gas. Condensate thus formed is then separated from the dried gas in a liquid separator, and the dried gas is subsequently heated such that said dried gas is no longer saturated with moisture.

Compressed air originating from a compressor is usually saturated with water vapour. In other words, it has a relative humidity of 100%. This means the condensation of the water vapour from the compressed air will occur when this compressed air is cooled to under the dew point, also known as "pressure dew point" or "PDP" for short. Since condensed water vapour can cause corrosion and premature wear in piping and tools taking compressed air from the compressor, it is necessary to dry the compressed air by means of the cool drying mentioned above.

When cooling compressed air, the compressed air must not be cooled too much, since otherwise the condensed water vapour formed would freeze and cause the heat exchanger to lose its heat exchange capacity. Such freezing of the formed condensed water vapour is also called "freezing".

Typically, the dried compressed air thereto has a temperature of 2° C. or 3° C. To this end, an evaporation temperature "Tevap" of the cooling agent must lie above a certain value, specific for the heat exchanger.

A minimum temperature of the dried compressed air, which minimum temperature determines the occurrence of water vapour condensation and the freezing of the formed condensed water vapour, is also called the "lowest air temperature" or referred to as "LAT" for short.

To allow any condensation of water vapour to occur, the LAT must be lower than the dew point of the compressed gas. To avoid any freezing of condensed water vapour in the heat exchanger, the LAT must be higher than a freezing point of said condensed water vapour.

A particularly efficient heat exchange between the compressed air and the cooling agent is achieved when the cooling agent in the channels is subject to an evaporation process during the heat exchange. After all, during this evaporation process the cooling agent absorbs heat from the compressed air, while the temperature of the cooling agent remains constant and does not rise. Because of this, the temperature difference between the compressed air and the cooling agent, which temperature difference is the driving force for the heat exchange between the compressed air and the cooling agent, remains as maximal as possible without additional cooling of the cooling agent.

For this reason, the cooling agent is typically presented to the channels of the heat exchanger as a two-phase fluid flow of gas or vapour on the one hand and liquid on the other hand.

For an optimal evaporation of the liquid in the channels of the heat exchanger, the liquid should be dispersed as small liquid particles in the two-phase fluid flow.

Heat exchange performance of a channel in the heat exchanger is in this case highly sensitive to changes in an initial fraction of gas or vapour of a two-phase fluid flowing through this channel. "An initial gas or vapour fraction" in this context means the fraction of gas or vapour of the two-phase fluid before heat exchange with the compressed air occurs. An increased initial fraction of gas or vapour of said two-phase fluid leads to a reduced heat exchange with the compressed air. In addition, such an increased initial fraction of gas or vapour is accompanied by an increased pressure drop across the channel, resulting in a lower flow rate of the two-phase fluid in the channel, which further reduces the heat exchange with the compressed air.

An uneven distribution of the incoming two-phase fluid flow of the cooling agent across the channels of the heat exchanger can lead to:

- not achieving the required LAT below the dew point in the heat exchanger for each channel;
- the lack of representativeness of a local measurement of the LAT for all channels of the heat exchanger;
- the achievement of a lower LAT under lower load conditions than under nominal load conditions of the refrigeration dryer, which implies a risk of partial freezing of the heat exchanger;
- by partially freezing the heat exchanger under lower load conditions, a rise of the dew point of the compressed air and an increased pressure drop over the heat exchanger;
- a highly unstable overheating of the cooling agent sent to the outlet collector of the heat exchanger, which, in the case of the cooling agent being recirculated in a closed cooling circuit, requires complex control of an electronic expansion valve in said cooling circuit.

To avoid the aforementioned disadvantages, the two-phase fluid flow must be evenly distributed with the liquid particles across the channels of the heat exchanger.

The use of flow-rate distribution devices in the inlet collector of a heat exchanger for evenly distributing an incoming fluid flow across the channels is well known to this end.

A first type of flow-rate distribution means is a so-called distribution pipe, along which the incoming fluid flow can be fed into a chamber in the inlet collector via mutually spaced orifices in, or nozzles on, the distribution pipe, as described for example in CN 208,805,086 U.

Across the distribution pipe itself and in the orifices or nozzles distributed on the distribution pipe, however, a high pressure drop may occur.

In addition, the ideally required diameter and diameter distribution of the orifices or nozzles for a uniformly distributed two-phase fluid flow in the channels of the heat exchanger is difficult to determine.

As a second option, a structured medium, also known as "packing" or "filler", can be placed in the inlet collector, as also described in CN 208,805,086 U.

In the structured medium, the incoming fluid flow is split into partial flows and said partial flows are mixed with each other in such a way that a uniform fluid flow can be distributed evenly across the channels.

However, the frequent splitting and mixing of the partial flows in the structured medium has the disadvantage of a high pressure drop over the inlet collector.

In addition, when the incoming fluid flow is a two-phase mixture of gas or vapour and liquid particles, the liquid particles can be deposited on the structured medium by collision, interception or diffusion, resulting in separation of the liquid particles from the two-phase mixture and thus a less uniform fluid flow in the channels of the heat exchanger.

A third possibility is to place insert pieces, also known as "inserts", in the inlet collector that divide and possibly deflect the incoming fluid flow in order to obtain a more even distribution of said incoming fluid flow than in the case where there would be no insert pieces present in the inlet collector.

In CN 106,989,629 the inserts are implemented as plates with circular perforations in the inlet collector.

In practice, the required diameter distribution of the perforations for a uniformly distributed two-phase fluid flow in the channels of the heat exchanger is difficult to determine, as also mentioned in CN 207,456,261.

CN 207,456,261 describes an inlet collector for a plate-fin heat exchanger in which a pyramid structure of multiple triangular partition plates, also known as "baffles", are positioned as inserts in the inlet collector through which the incoming fluid stream flows into the inlet collector.

The pyramid structure with several partition plates, however, causes a high pressure drop over the inlet collector. In addition, this pyramid structure is complex to mount in the inlet collector or to incorporate in some other way.

US 2003/011121 describes a heat exchanger with an inlet collector that comprises curved guide plates in an inlet collector chamber. The guide plates serve to distribute an incoming fluid flow evenly across a number of channels of the heat exchanger by deflecting the incoming flow in the direction of the outer channels.

After the fluid stream enters the inlet collector through an inlet, however, the fluid arrives in a large volume formed by the inlet collector chamber, since the guide plates occupy little volume in the inlet collector chamber. This reduces the velocity of the fluid in the inlet collector chamber. In case the incoming fluid flow consists of a two-phase fluid, this velocity reduction of the fluid in the inlet collector chamber may lead to separation of different phases in the fluid. As a result, an initial fraction of gas in the flows through the channels of the heat exchanger will not be uniformly distributed across these channels.

The present invention aims at offering a solution to one or more of the aforementioned and/or other disadvantages.

To this end, the invention relates to a heat exchanger for exchanging heat between two fluids, respectively a first initially two-phase fluid and a second fluid, where the heat exchanger comprises the following components:

a housing that encloses an internal cavity;

a set of channels, where each one of the channels in said set passes through the internal cavity of the housing;

an inlet collector comprising a wall with an inlet for the first initially two-phase fluid, which inlet is in fluid communication with an inlet collector chamber within the inlet collector, where both the inlet and the inlet collector chamber are symmetrical in planes of symmetry according to a first plane of symmetry and a second plane of symmetry intersecting said first plane of symmetry, the inlet collector being hermetically connected to the housing on one side of the inlet collector disposed opposite the wall with the inlet, and where the inlet collector chamber comprises first flow-rate distribution means configured to distribute a first initially two-phase fluid flow originating from the inlet evenly across the set of channels; and an outlet collector comprising a wall with an outlet for the first initially two-phase fluid, which outlet is in fluid communication with an outlet collector chamber in the outlet collector, where said outlet collector is hermetically connected to the housing on a side of the outlet collector disposed opposite the wall with the outlet, where all inlet orifices of the set of channels are in fluid communication with the inlet collector chamber and all outlet orifices of the set of channels are in fluid communication with the outlet collector chamber, where the inlet orifices of the channels are symmetrically arranged with respect to each other according to the first plane of symmetry and the second plane of symmetry, characterized in that the first flow-rate distribution means consist of a single body comprising two flow-conducting surfaces, which two flow-conducting surfaces are symmetrical with respect to each other according to the first plane of symmetry and the second plane of symmetry, and which two flow-conducting surfaces, as seen from the inlet, are inclined downward in a first direction perpendicular to the first plane of symmetry and/or in a second direction perpendicular to the second plane of symmetry.

The advantage of such a heat exchanger is that the first flow-rate means guide the first initially two-phase fluid towards the inlet orifices of the channels of which the inlet orifice is furthest from the inlet in a direction perpendicular to a direction with which the first initially two-phase fluid enters the inlet collector chamber through the inlet.

As a result, the first initially two-phase fluid is distributed uniformly across the inlet orifices of all channels.

Due to the fact that the first flow-rate distribution means consist of only a single body, it can also be easily and quickly installed in the inlet collector chamber or otherwise incorporated.

In a preferred embodiment of the invention, the inlet orifices of the set of channels are arranged in a straight line according to the first direction and symmetrically with respect to each other according to the first plane of symmetry.

This allows a narrow and therefore compact implementation of the inlet collector in the second direction.

In a more preferred embodiment of the invention, the two flow-conducting surfaces, as seen from the inlet, are inclined downward in the first direction only.

After all, in order to ensure uniform distribution of the first initially two-phase fluid across the inlet orifices of the channels, the two flow-conducting surfaces of the first flow-rate distribution means, as seen from the inlet, should only be inclined downward in the first direction.

The downward inclination of the two flow-conducting surfaces also, as seen from the inlet, in the second direction will not make the distribution of the first initially two-phase fluid across the inlet orifices of the channels significantly more uniform in this case, and is consequently not strictly necessary.

If the two flow-conducting surfaces, as seen from the inlet, are not inclined downward in the second direction, the first flow-rate distribution means have a less complex geometry than if the two flow-conducting surfaces, as seen from the inlet, were inclined downward in the second direction. Such first flow-rate distribution means can therefore be produced and/or mounted in the inlet collector chamber in a simple manner.

In a next preferred embodiment of the invention, the single body of the first flow-rate distribution means comprises a through-hole having an axis according to a straight line common to the first plane of symmetry and the second plane of symmetry.

In this way, the channels of which the inlet orifice is closest to the inlet in a direction perpendicular to a direction in which the first initially two-phase fluid enters the inlet collector chamber, can be provided with the first initially two-phase fluid in a controlled way.

In a next preferred embodiment of the invention, the inlet collector chamber is bounded by a wall of the inlet collector, which wall has a surface facing the inlet collector chamber that stands opposite and substantially parallel to the two flow-conducting surfaces.

As a result, the flow-conducting surfaces of the first flow diaphragm and the aforementioned wall of the inlet collector form a passage for the first initially two-phase fluid, which passage may have a constant cross-sectional area in a direction in which the first initially two-phase fluid flows through the passage.

This ensures that a velocity at which the first initially two-phase fluid flows through this passage is maintained and does not decrease upon entry of the first initially two-phase fluid into the inlet collector chamber, thus maintaining distribution of a liquid phase in the first initially two-phase fluid as small liquid particles.

In a next preferred embodiment of the invention, each one of the channels in the set of channels has a constant diameter D; and, in a direction common to the first plane of symmetry and the second plane of symmetry, the inlet collector chamber is smaller than 2.0 times the diameter D, preferably smaller than 1.5 times the diameter D, more preferably smaller than 1.0 times the diameter D.

This also ensures that a velocity at which the first initially two-phase fluid flows through this passage is maintained and does not decrease upon entry of the first initially two-phase fluid into the inlet collector chamber, thus maintaining distribution of a liquid phase in the first initially two-phase fluid as small liquid particles.

In a next preferred embodiment of the invention, a cross section of the first flow-rate distribution means, considered in a plane equal to or parallel to the first plane of symmetry or the second plane of symmetry, comprises a substantially full figure formed by the two flow-conducting surfaces and a substantially straight base, the flow-conducting surfaces each being connected by the base at an end situated furthest away from the inlet.

A 'substantially full figure' in this context means that all or almost all points of this figure form part of the single body of the first flow-rate distribution means.

In this case, the cross-section of the first flow-rate distribution means, considered in a plane equal or parallel to the first plane of symmetry or the second plane of symmetry, preferably comprises a substantially full and substantially isosceles triangle of which the equal-length sides are formed by the two flow-conducting surfaces.

Alternatively, the cross section of the first flow-rate distribution means, considered in a plane equal or parallel to the first plane of symmetry or the second plane of symmetry, preferably comprises a substantially full and substantially isosceles trapezium of which the equal-length sides are formed by the two flow-conducting surfaces.

By executing the first flow-rate distribution means with such a cross section, said first flow-rate distribution means will occupy a certain volume in the inlet collector chamber. As a result, a free volume in the inlet collector chamber that is not occupied by the first flow-rate distribution means, and besides that an area occupied by the first initially two-phase fluid flow in that inlet collector chamber, will be smaller. By this, the first initially two-phase fluid flow in the inlet collector chamber will decelerate less, thus reducing or avoiding the separation of the different phases in the first initially two-phase fluid flow. This ensures that an initial fraction of gas in the flows through the channels of the heat exchanger will be more uniformly distributed across said channels.

In a next preferred embodiment of the invention, in the first direction and/or in the second direction, a dimension of the inlet is approximately equal to or greater than a dimension of the first flow-rate distribution means.

This allows the inlet collector to be produced as a single piece simultaneously with the first flow-rate distribution means with the aid of a standard machining technique, since after the inlet has been formed the location for the flow-conducting surfaces of the first flow-rate distribution means is then easily accessible along the inlet.

In this way, on the one hand, no advanced and expensive additive manufacturing techniques are required, and on the other hand, the first flow-rate distribution means do not need to be manufactured separately before being mounted in the inlet collector chamber. This enables easy and fast production of the inlet collector with the first flow-rate distribution means.

In a following preferred embodiment of the invention, the outlet collector chamber has a substantially cuboid shape, where the outlet orifices of the channels are in fluid communication with the outlet collector chamber on a first side of the outlet collector chamber, and where the outlet is in fluid communication with the outlet collector chamber on a second side of the outlet collector chamber opposite the aforementioned first side of the outlet collector chamber.

The straight, substantially cuboid shape of the outlet collector chamber creates space for a uniform outflow of the first initially two-phase fluid in the outlet collector chamber across all channels. This creates a uniform back pressure in the outlet collector chamber, which distributes a flow-rate of first initially two-phase fluid uniformly across the channels formed by the channels. An overall negative effect of back pressure, consisting of reducing the total flow-rate that can flow through these channels, is thus compensated for by a reduced pressure drop and an increased flow-rate through the channels of the outer channels.

In a more preferred embodiment of the invention, each one of the channels in the set of channels has a constant diameter D; and a perpendicular distance between the aforementioned first side and the aforementioned second side is minimally 1.0 times the diameter D, preferably minimally 1.5 times the diameter D, more preferably minimally 2.0 times the diameter D, with even greater preference minimally 3.0 times the diameter D.

The larger the outlet collector chamber, the more uniform the outflow of the first initially two-phase fluid into the outlet collector chamber and the more uniform the flow-rate distribution of the first initially two-phase fluid across the set of channels.

In a next preferred embodiment of the invention, the heat exchanger further comprises an intermediate collector between the inlet collector and the outlet collector, which intermediate collector is provided with second flow-rate distribution means configured such that a flow of the first initially two-phase fluid in a channel in the set of channels can be at least partially diverted from this channel to and into another channel of the set of channels.

Said second flow-rate distribution means achieve pressure equalization in the various channels, resulting in a uniform distribution of the first initially two-phase fluid across the channels.

The invention further also relates to a refrigeration dryer for cooling and dehumidifying a gas compressed in a compressor installation, said refrigeration dryer comprising a heat exchanger according to one or more of the preceding embodiments.

It goes without saying that such a refrigeration dryer enjoys the same advantages as the heat exchanger embodiments described above.

Finally, the invention also relates to a method for the manufacture of a heat exchanger for exchanging heat between two fluids, respectively a first initially two-phase fluid and a second fluid, where the following components are integrated into the heat exchanger:

a housing that encloses an internal cavity;

a set of channels, where each one of the channels in said set of channels passes through the internal cavity of the housing;

an inlet collector comprising a wall with an inlet for the first initially two-phase fluid, which inlet is in fluid communication with an inlet collector chamber in the inlet collector, where both the inlet and the inlet collector chamber are symmetrical in accordance with a first plane of symmetry and a second plane of symmetry intersecting said first plane of symmetry, where the inlet collector is hermetically connected to the housing on a side facing the wall with the inlet, and where the inlet collector chamber comprises first flow-rate distribution means for evenly distributing a first initially two-phase fluid flow originating from the inlet across the set of channels; and an outlet collector comprising a wall with an outlet for the first initially two-phase fluid, which outlet is in fluid communication with an outlet collector chamber in the outlet collector, where said outlet collector is hermetically connected to the housing on a side of the outlet collector disposed opposite the wall with the outlet, where all inlet orifices of the set of channels are connected in fluid connection to the inlet collector chamber and all outlet orifices of the set of channels are connected in fluid connection to the outlet collector chamber, in where the inlet orifices of the channels are arranged symmetrically with respect to each other according to the first plane of symmetry and the second plane of symmetry, characterized in that that the first flow-rate distribution means are implemented as a single body comprising two flow-conducting surfaces, which two flow-conducting surfaces are symmetrical to each other according to the first plane of symmetry and the second plane of symmetry, and, as seen from the inlet, inclined downward in a first direction perpendicular to the first plane of symmetry and/or in a second direction perpendicular to the second plane of symmetry.

In a preferred embodiment of the method according to the invention, the inlet is implemented with, in the first direction and/or in the second direction, a dimension which is approximately equal to or greater than a dimension of the first flow-rate distribution means.

In a more preferred embodiment of the method according to the invention, the inlet collector is manufactured integrally with the first flow-rate distribution means by means of a machining technique.

In this context, the term "the inlet collector is integrally manufactured with the first flow-rate distribution means" means that the inlet collector and the first flow-rate distribution means are simultaneously manufactured from a same piece of material.

Implementing the first flow-rate distribution means in such a way obviously provides the same advantages as a heat exchanger with the first flow-rate distribution means as described above.

With a view to better demonstrating the features of the invention, a number of preferred embodiments of a heat exchanger in accordance with the invention are hereafter, by way of example without any restrictive character, shown below, as well as of an inlet collector and outlet collector for use in such a heat exchanger, with reference to the accompanying figures, in which.

Figure 3A:
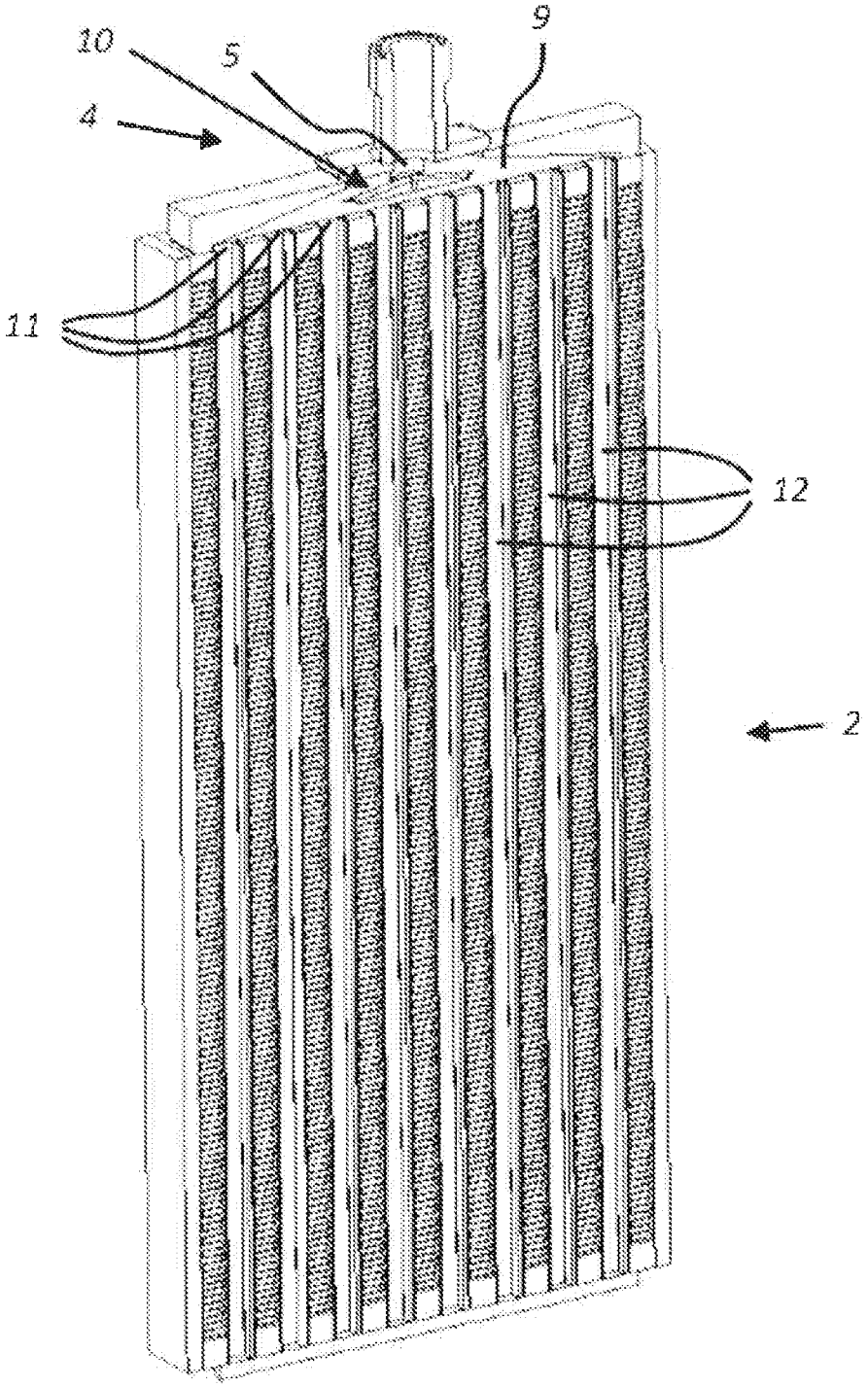
Figure 3B:
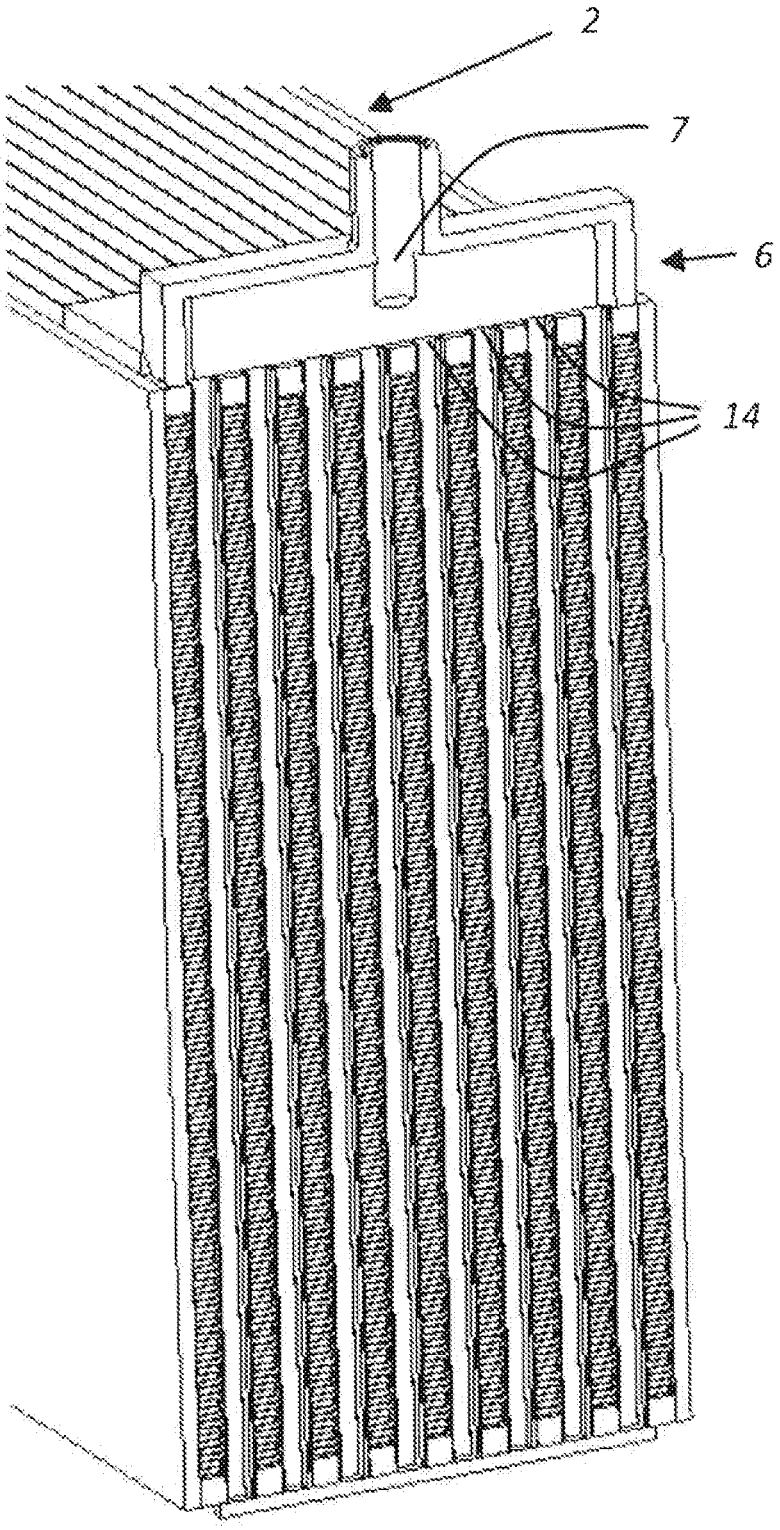
Figure 4A:
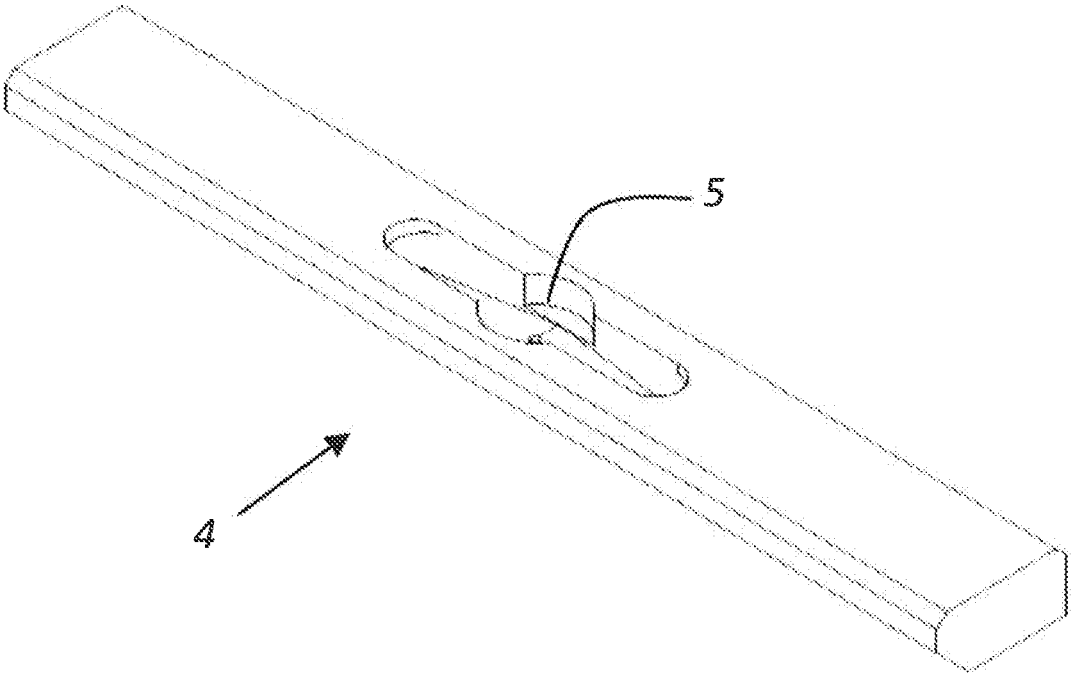
Figure 4B:
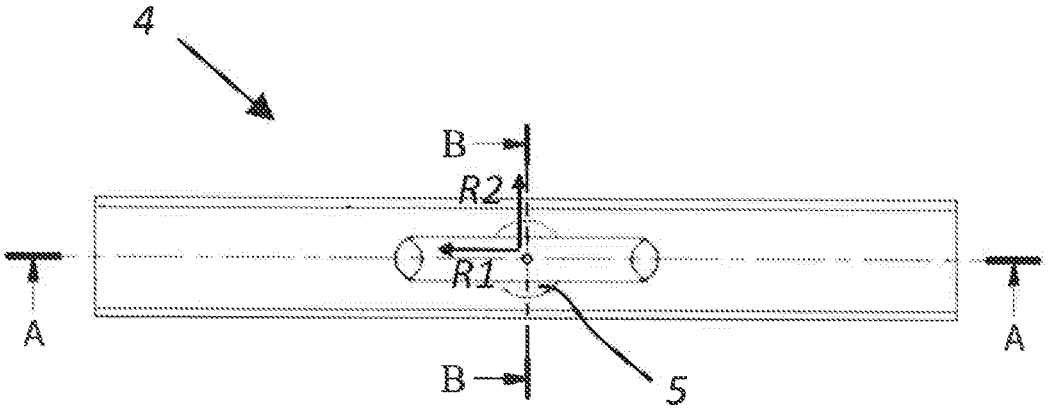
Figure 4C:
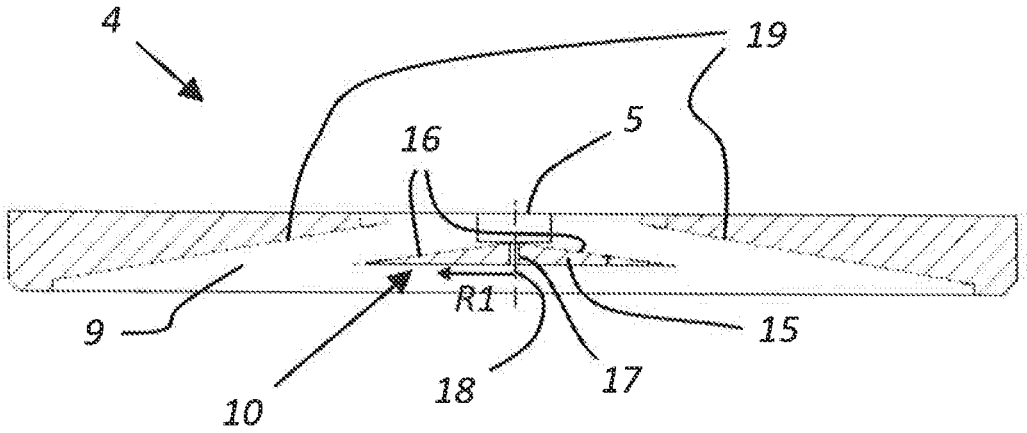

FIG. 3*a* shows a heat exchanger with an open view of an inlet collector according to the invention;

FIG. 3*b* shows the heat exchanger in FIG. 3*a* with an open view of an outlet collector according to the invention;

FIG. 4*a* shows an isometric view of an inlet collector according to the invention;

FIG. 4*b* shows a view of the inlet collector in FIG. 4*a* according to a direction perpendicular to the inlet of the inlet collector;

FIG. 4*c* shows a view of the inlet collector in FIG. 4*a* according to an intersection A-A in FIG. 4*b;*

Figure 5A:
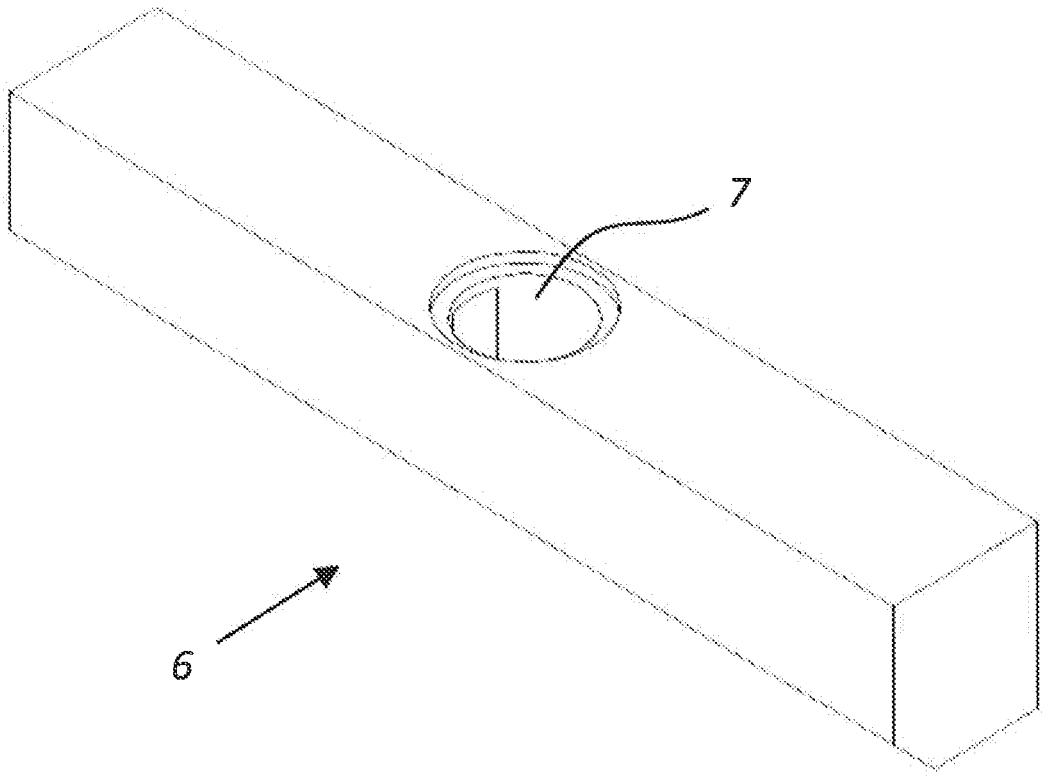
Figure 5B:
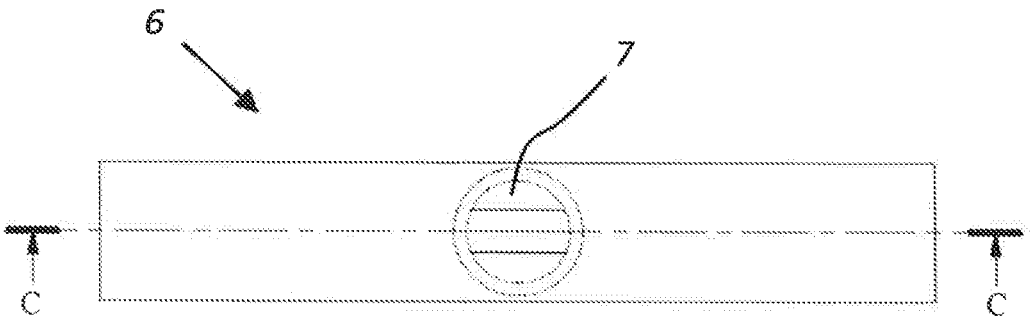
Figure 5C:
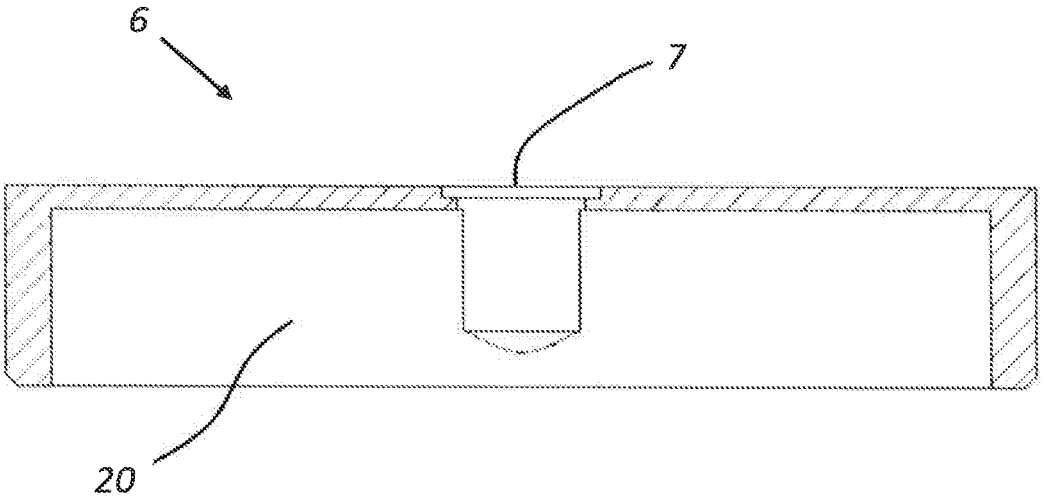

FIG. 5*a* shows an isometric view of an outlet collector according to the invention;

FIG. 5*b* shows a view of the outlet collector in FIG. 5*a* according to a direction perpendicular to the outlet of the outlet collector;

FIG. 5*c* shows a view of the inlet collector in FIG. 5*a* according to an intersection C-C in FIG. 5*b;*

Figure 1:
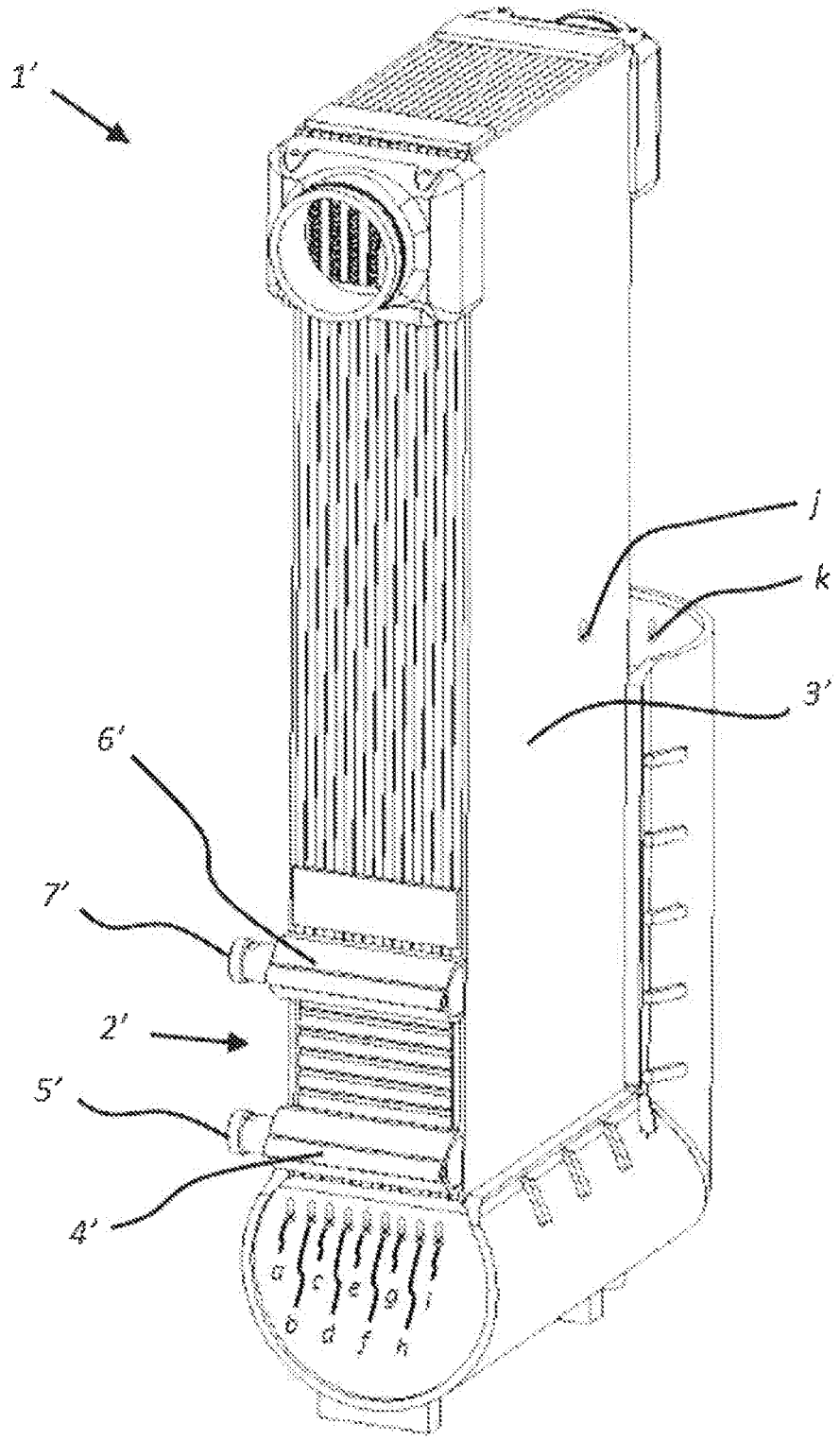
FIG. 1 shows a conventional refrigeration dryer according to the known prior art.
Figure 6:
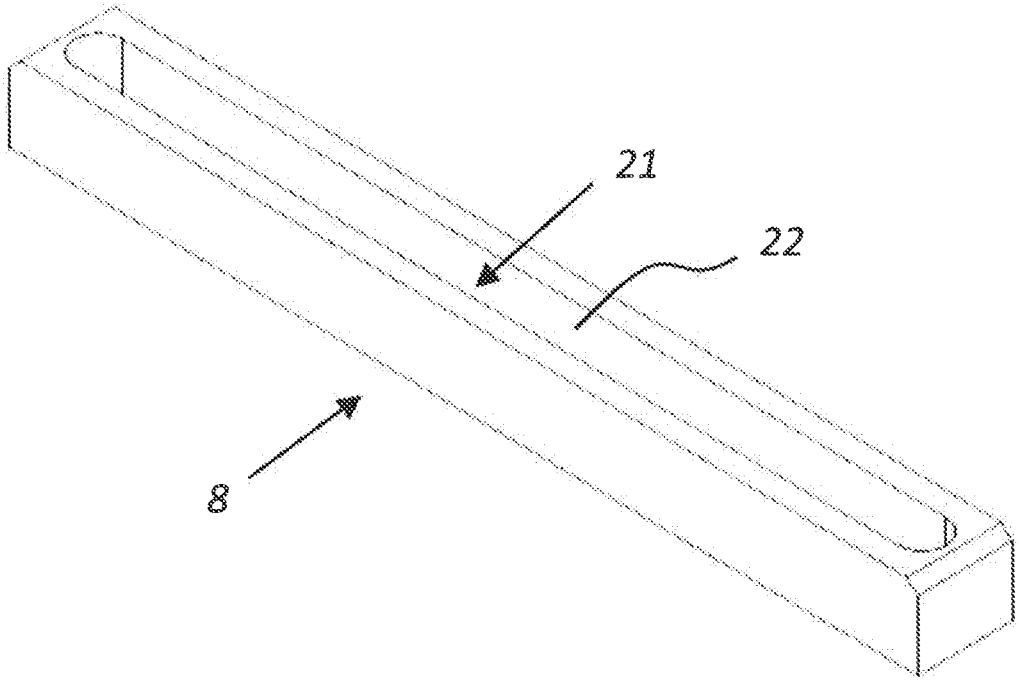
Figure 7:
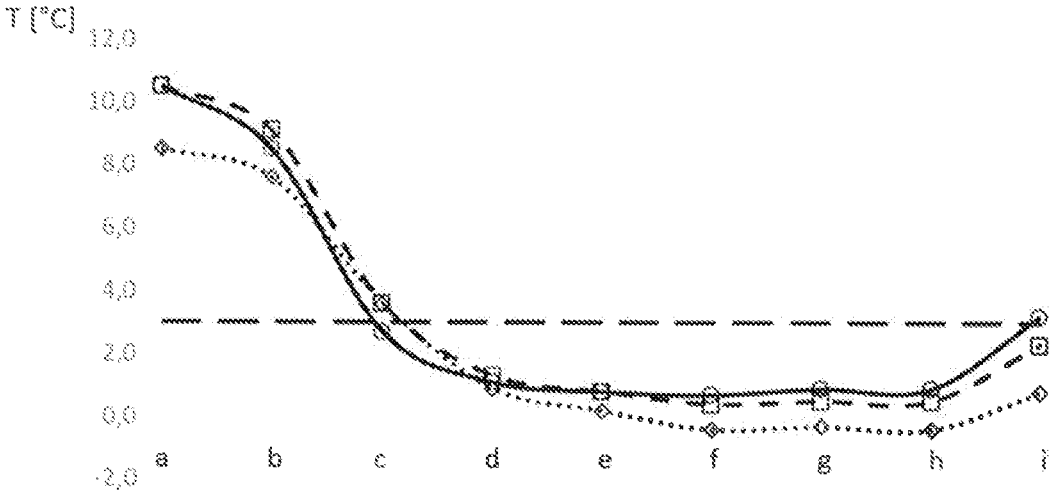
Figure 8A:
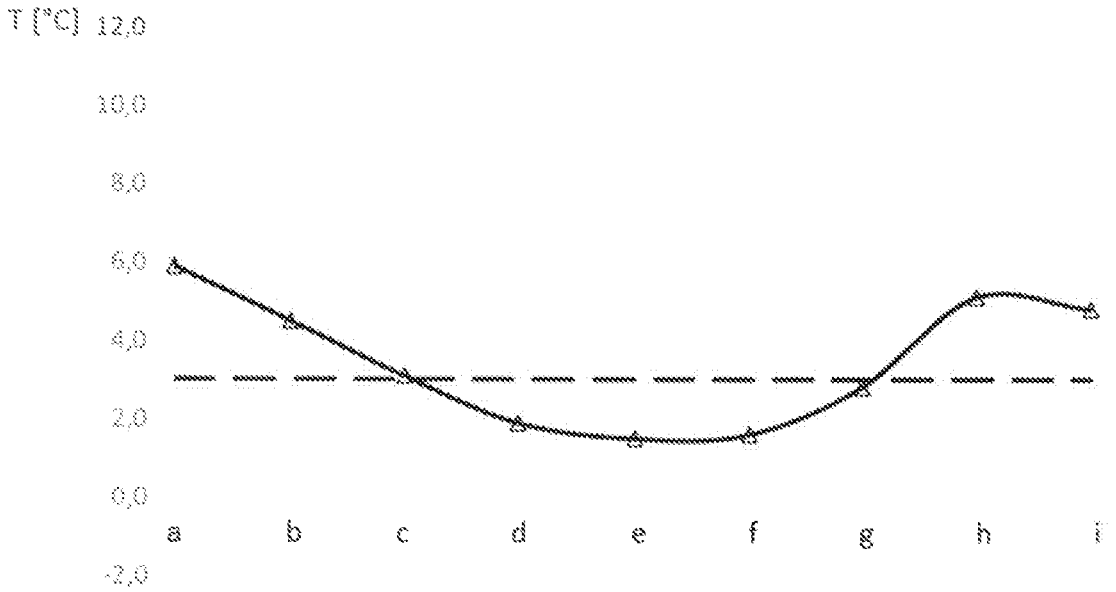
Figure 8B:
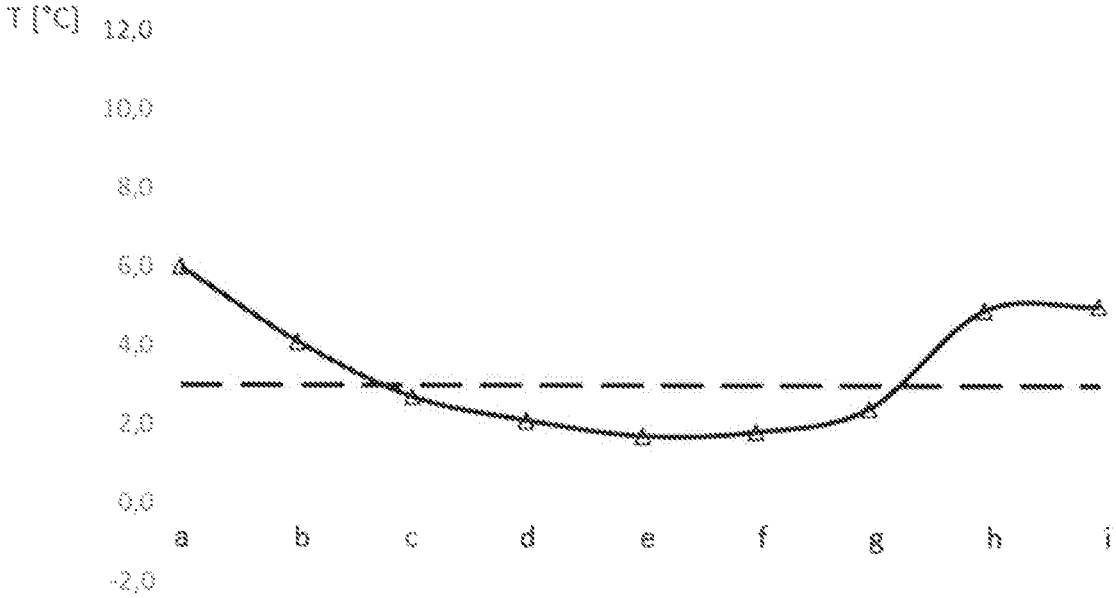
Figure 8C:
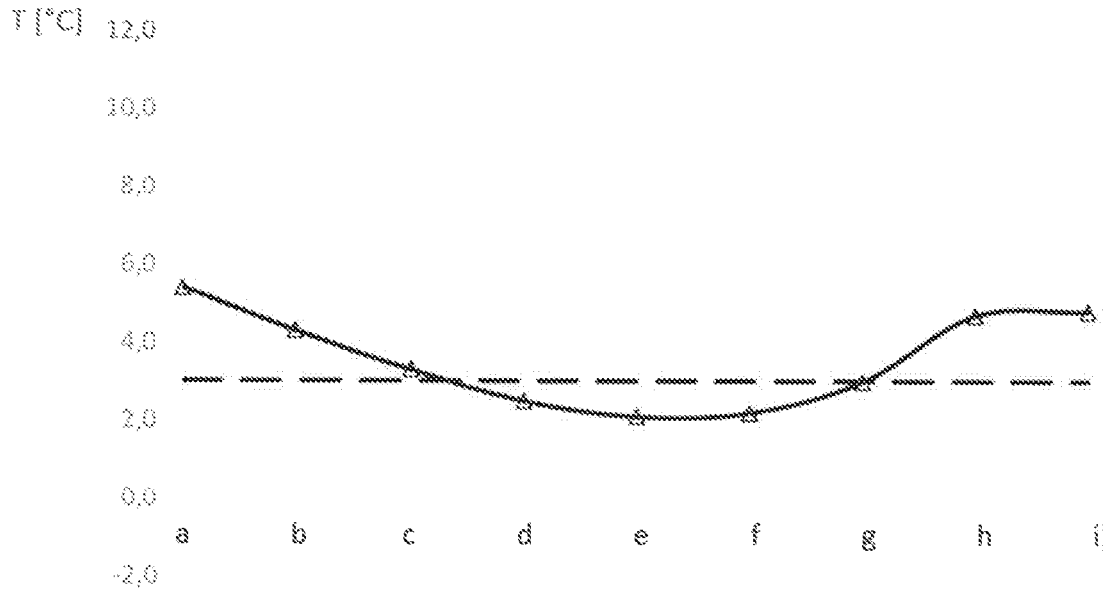
Figure 8D:
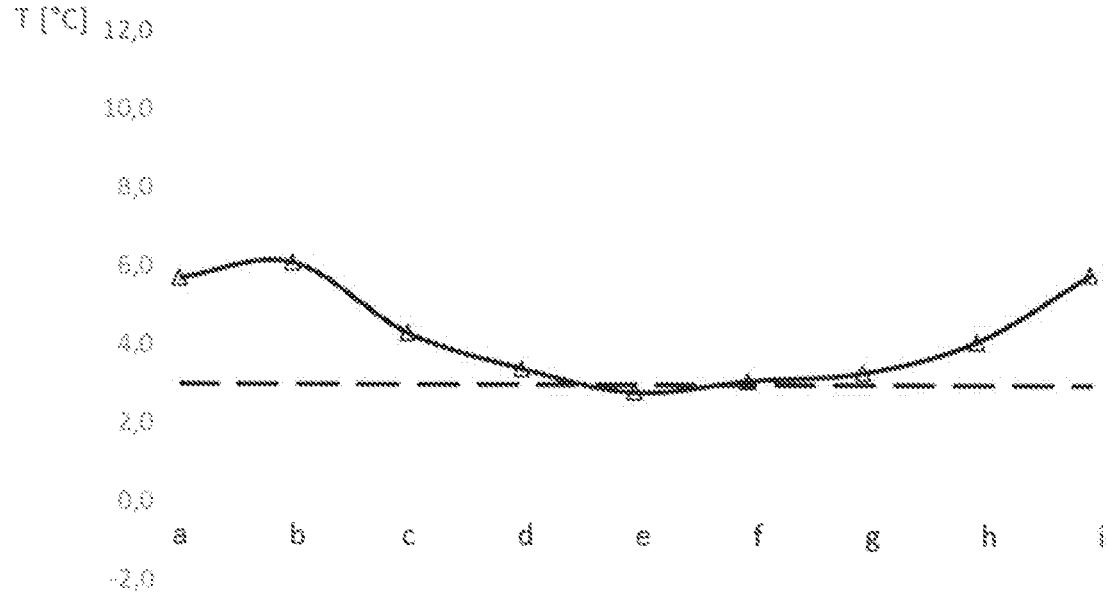
Figure 9:
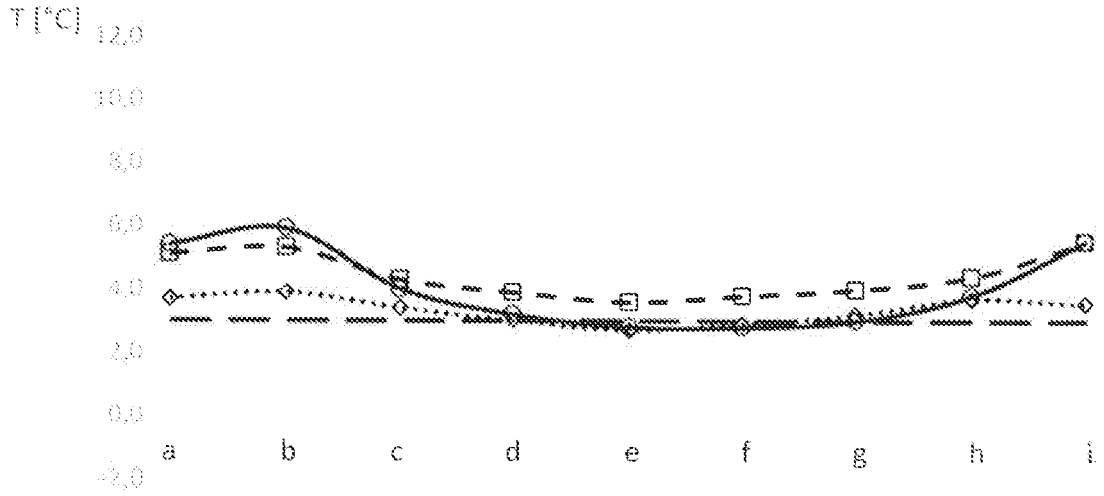

FIG. 6 shows an isometric view of an intermediate collector according to the invention;

FIG. 7 shows a temperature distribution of dried compressed air in a housing of the conventional heat exchanger in FIG. 1;

FIGS. 8*a-d* show a temperature distribution of dried compressed air in a housing of a heat exchanger according to four variants of the invention;

FIG. 9 shows a temperature distribution of dried compressed air in a housing of a heat exchanger according to the fourth variant of the invention in FIG. 8*d* at low airflow rates.

The conventional refrigeration dryer 1' in FIG. 1 for drying compressed air from a compressor plant comprises a heat exchanger 2' with a housing 3' enclosing an internal cavity and a set of channels, each of the channels in this set passing through the housing 3', the internal cavity and again through the housing 3'.

The air to be dried flows in the internal cavity across the channels. Said compressed air to be dried is cooled by sending an initially two-phase cooling agent through the channels. Said initially two-phase cooling agent evaporates as it passes through these channels due to heat exchange with the compressed air in the internal cavity around the channels.

The heat exchanger 2' further comprises an inlet collector 4' with a side inlet 5' for the initially two-phase cooling agent. The inlet collector 4' is hermetically attached to the housing 3' across all inlet orifices of the channels. In this way, the inlet orifices of the channels are in fluid communication with an inlet collector chamber in the inlet collector 4', which inlet collector chamber collects a flow of the initially two-phase cooling agent that enters the inlet collector 4' via the side inlet 5'.

The inlet collector chamber may have a distribution pipe, a structured medium or inserts to distribute the initially two-phase cooling agent entering the inlet collector 4' via the side inlet 5' uniformly across the set of channels.

Furthermore, the heat exchanger 2' comprises an outlet collector 6' with an outlet 7' for the initially two-phase cooling agent. The outlet collector 6' is hermetically attached to the housing 3' across all outlet orifices of the channels. In this way, the outlet orifices of the channels are in fluid communication with an outlet collector chamber in the outlet collector 6', which outlet collector chamber collects flows of the initially two-phase cooling agent that enters the outlet collector 6' via the outlet orifices of the channels. The initially two-phase cooling agent can then leave the outlet collector 6' via the outlet 7'.

Figure 2:
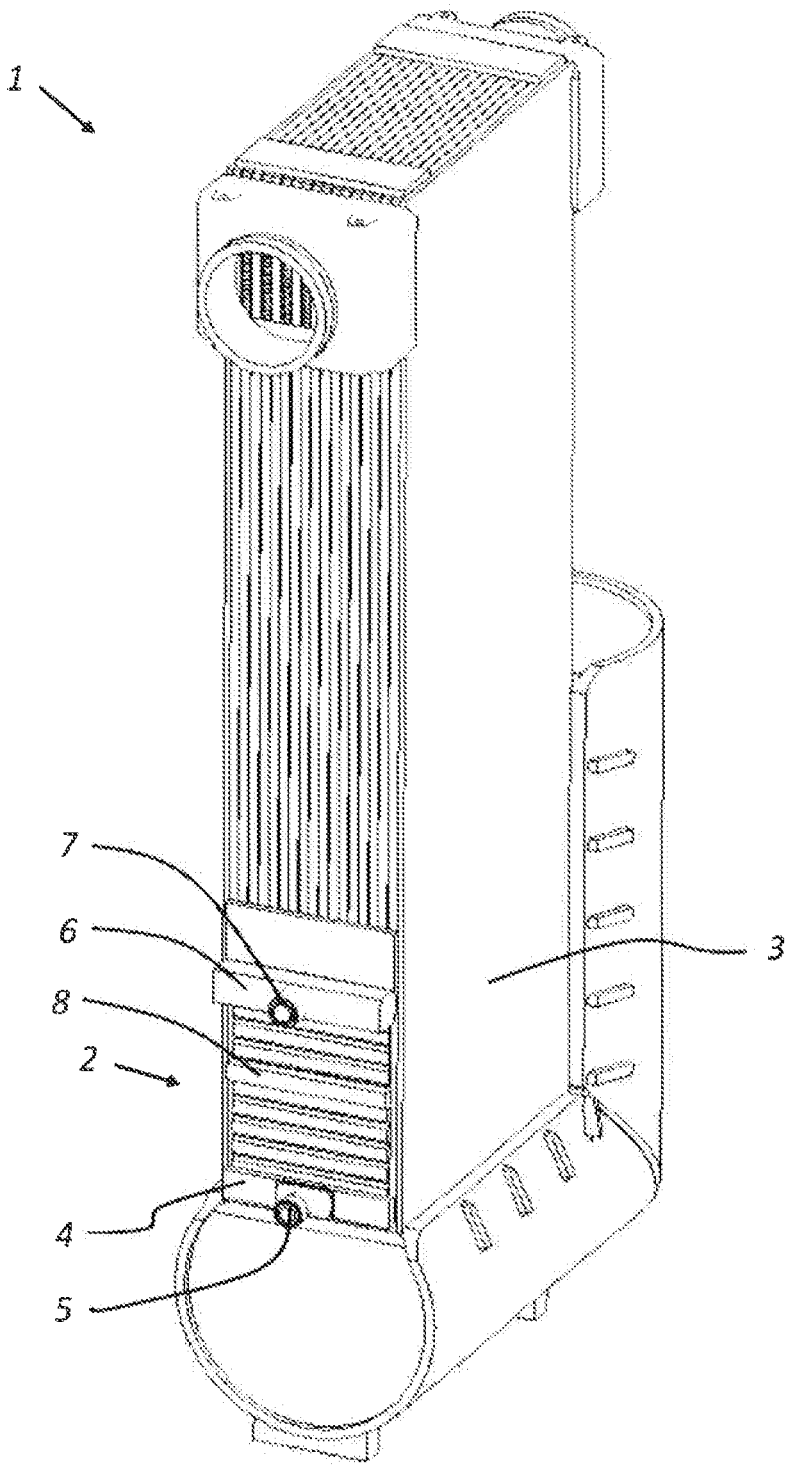
FIG. 2 shows a refrigeration dryer with a heat exchanger according to the invention.

The refrigeration dryer 1 according to the invention in FIG. 2 comprises, analogously to the conventional refrigeration dryer 1' in FIG. 1, a heat exchanger 2 with a housing 3 enclosing an internal cavity and a set of channels, each of the channels in this set passing through the housing 3, then the internal cavity and again through the housing 3.

An inlet collector 4 of the heat exchanger 2 has an inlet 5 for an initially two-phase cooling agent. In this case, this inlet 5 is centrally located opposite the inlet orifices of the channels, which in itself ensures a more uniform distribution of a flow of initially two-phase cooling agent entering through said inlet 5 than would be the case with a side inlet 5' such as in the heat exchanger 2' of the conventional refrigeration dryer 1' in FIG. 1.

Similarly, an outlet 7 of an outlet collector 6 of the heat exchanger 2 is centrally located opposite the outlet orifices of the channels, which offers an analogous advantage in comparison with the side outlet 7' such as in the heat exchanger 2' of the conventional refrigeration dryer 1' in FIG. 1.

Optionally, the heat exchanger 2 is also equipped with an intermediate collector 8 for levelling pressure levels in the set of channels between the inlet collector 4 and the outlet collector 6.

FIG. 3*a* shows the heat exchanger 2 in FIG. 2 with an open view of the inlet collector 4, and FIG. 3*b* shows the heat exchanger 2 in FIG. 2 with an open view of the outlet collector 6.

In the inlet collector chamber 9 first flow-rate distribution means 10 are disposed which distribute and direct the flow of the initially two-phase cooling agent entering the inlet collector 4 through the inlet 5 to the inlet orifices 11 of the channels 12, which channels 12 pass through the internal cavity enclosed by the housing 3 of the heat exchanger 2 and finally exit through the outlet orifices 14 into the outlet collector 6 with the outlet 7.

FIG. 4*a* shows an isometric view of the inlet collector 4 with inlet 5.

Said inlet 5 is in this case implemented as an elongated slot of which the dimensions, in a direction perpendicular to said inlet 5, are approximately equal to the dimensions of the first flow-rate distribution means 10. As a result, when the inlet collector 4 is produced, the location of the first flow-rate distribution means 10 is easily accessible after said inlet 5 has been formed, so that the first flow-rate distribution means 10 can then be easily formed using a standard machining technique.

FIG. 4*b* shows a view of the inlet collector 4 in FIG. 4*a* according to a direction perpendicular to the inlet 5 of the inlet collector 4, while FIG. 4*c* shows a view of said inlet collector 4 in FIG. 4*a* according to an intersection A-A in FIG. 4*b*.

Both inlet 5 and inlet collector chamber 9 are symmetrical according to a first plane of symmetry B-B and a second plane of symmetry coinciding with the plane of intersection A-A and intersecting this first plane of symmetry B-B.

The first flow-rate distribution means 10 consist of a single body 15 comprising two flow-conducting surfaces 16 which are symmetrical with respect to each other according to the first plane of symmetry B-B and the second plane of symmetry A-A, and which two flow-conducting surfaces 16, as seen from the inlet 5, incline downward in a first direction R1 perpendicular to the first plane of symmetry and/or in a second direction R2 perpendicular to the second plane of symmetry.

In this case, the single body 15 of the first flow-rate distribution means 10 is implemented with a cross section which, considered in a plane equal or parallel to the plane of intersection A-A, comprises a substantially full and substantially isosceles triangle of which the sides of equal length are formed by the two flow-guide surfaces 16.

It would not be excluded in the scope of the invention that alternatively or similarly a cross section, considered in a plane equal or parallel to the intersection plane B-B, would include a substantially full and substantially isosceles triangle of which the sides of equal length were formed by the two flow-conducting surfaces.

It would not be excluded in the scope of the invention that alternatively or similarly a cross-section, considered in a plane equal or parallel to the intersection plane B-B, would include a substantially full and substantially isosceles triangle of which the sides of equal length were formed by the two flow-conducting surfaces.

The inlet orifices 11 of the channels formed by the set of channels 12 are arranged in a straight line according to the first direction R1 and symmetrically with respect to each other according to the first plane of symmetry B-B.

In the context of the invention, however, it cannot be excluded that the inlet orifices of the set of channels are arranged symmetrically with respect to each other in some other way according to the first plane of symmetry and the second plane of symmetry, for example when the inlet orifices are disposed at a regular distance on concentric circles or when the inlet orifices are positioned according to a pattern corresponding to grid points of a rectangular grid or a hexagonal honeycomb grid.

The single body 15 of the first flow-rate distribution means 10 may optionally include a through-hole 17 having an axis 18 according to a straight line common to the first plane of symmetry B-B and the second plane of symmetry A-A.

The inlet collector 4 includes a wall delimiting the inlet collector chamber 9, which wall has a surface 19 facing the inlet collector chamber 9 that is opposite and substantially parallel to the two flow-conducting surfaces 16. This allows a velocity of the initially two-phase cooling agent entering the inlet collector chamber 9 along inlet 5 to be maintained, which reduces the likelihood of liquid particles from the initially two-phase cooling agent precipitating against walls delimiting the inlet collector chamber 9, whereby these liquid particles remain better dispersed in the initially two-phase cooling agent.

In order to keep the velocity of the initially two-phase cooling agent as high as possible, a dimension of the inlet collector chamber 9 in a direction common to the first plane of symmetry B-B and the second plane of symmetry A-A is best chosen as small as possible, typically smaller than 2.0 times the diameter D of the channels formed by the set of channels 12.

FIG. 5*a* shows an isometric view of the outlet collector 6 with outlet 7.

FIG. 5*b* shows a view of the outlet collector 6 in FIG. 5*a* according to a direction perpendicular to the outlet 7 of the outlet collector 6, while FIG. 5*c* shows a view of the outlet collector 6 in FIG. 5*a* according to an intersection C-C in FIG. 5*b*.

The outlet collector chamber 20 has a substantially cuboid shape, where the outlet orifices 14 of the channels 12 are in fluid communication with the outlet collector chamber 20 on a first side of the outlet collector chamber 20 and where the outlet 7 is in fluid communication with the outlet collector chamber 20 on a second side of the outlet collector chamber 20 opposite the aforementioned first side of the outlet collector chamber 20.

To create a uniform outflow of the first initially two-phase cooling agent in the outlet collector chamber 20, a perpendicular distance between the aforementioned first side and the aforementioned second side is best chosen large enough, typically minimally 1.0 times the diameter D of the ducts.

FIG. 6 shows an isometric view of an intermediate collector 8 according to the invention.

Second flow-rate distribution means 21 are formed by an internal cavity 22 in the intermediate collector 8 configured such that a flow of the initially two-phase cooling agent in a channel in the set of channels 12 can be at least partially diverted from this channel to and into another channel of the set of channels 12. This allows pressure levels in the channels formed by the set of channels 12 to be equalized.

The inlet collector, outlet collector and intermediate collector described above can be produced in a simple and inexpensive way using a machining technique compared to more advanced techniques such as additive manufacturing.

COMPARATIVE EXAMPLE

As shown in FIG. 1, a FD 1010 VSD refrigeration dryer made by Atlas Copco Airpower was used to test a standard eight-row heat exchanger 1629 1926 00 made by AKG Thermotechnik to cool and dehumidify a flow rate of 1010 l/s, 750 l/s and 500 l/s of ambient air at an initial temperature of 25° C., which ambient air is brought to an overpressure of 7 barg and enters the heat exchanger at a temperature of 35° according to the conditions of ISO standard no. 7183 option A1. 7183 option A1.

In FIG. 7 a distribution is shown of a temperature of dried compressed air around all channels in the housing of the heat exchanger, measured at positions a to i, as a function of the flow rate of ambient air. In this case, the temperature of the dried compressed air is controlled to a setpoint of 3.0° C. according to ISO standard no. 8573-1 class 4 under test conditions of ISO standard no. 8573-3.

This setpoint is represented in FIG. 7 by a long-dashed line. The distribution of the temperature of dried compressed air is shown as

- a solid line with circular symbols for an ambient airflow rate of 1010 l/s;
- a short-dashed line with square symbols for an ambient airflow rate of 750 l/s; and
- a dotted line with rhombic symbols for an ambient airflow rate of 500 l/s.

In a water separator behind the heat exchanger, two measurements of the LAT are further carried out: a "LAT left" measurement at position j and a "LAT right" measurement at position k.

Finally, the dew point of the compressed air and the evaporation temperature of the initially two-phase cooling agent are determined.

This leads to the following measurement results:

| airflow rate | 1010 l/s | 750 l/s | 500 l/s |
|---|---|---|---|
| LAT left-LAT right(° C.) | 2.0, 3.7 | 1.8, 3.6 | 1.2, 4.0 |
| PDP (° C.) | 3.1 | 3.3 | 2.8 |
| Tevap (° C.) | −3.0 | −2.1 | −2.1 |

In this case, two parameters can be identified as performance indicators of the heat exchanger:

- a maximum value for the temperature difference "ΔTair" between a warmest and a coldest temperature of the dried air around the channels in the housing of the heat exchanger, in this case 9.8° C., 10.0° C. and 11.0° C. for an air flow rate of 1010 l/s, 750 l/s and 500 l/s respectively; and
- a proximity or approach, which is a temperature difference between the dew point PDP and the evaporation temperature Tevap, in this case 6.1° C., 5.4° C. and 4.9° C. for an air flow rate of 1010 l/s, 750 l/s and 500 l/s respectively.

Due to low temperatures of the dried compressed air at positions d to h, there is a risk that the heat exchanger would partially freeze there if the evaporation temperature of the cooling agent were to be further lowered by a pressure drop of the cooling agent, especially at low air flows. For this reason and because of high temperatures at positions a and b, a desired average temperature for the dried compressed gas of 3° C. cannot be achieved.

Examples 1 to 4

Example 1 differs from the comparative example in that the inlet collector of the heat exchanger is replaced by an inlet collector with first flow-rate distribution means according to the invention as shown in FIG. 4*a*-4*c*.

FIG. 8*a* shows for Example 1 the distribution of the temperature of dried compressed air around all channels in the housing of the heat exchanger, measured at positions a to i. This distribution is shown as a solid line with triangular symbols. The setpoint of 3.0° C. is represented by a long-dashed line.

Example 2 differs from the comparative example both in that the inlet collector of the heat exchanger is replaced by an inlet collector with first flow-rate distribution means according to the invention as shown in FIG. 4*a*-4*c*, and in that the outlet collector is replaced by an outlet collector according to the invention as shown in FIG. 5*a*-5*c*.

FIG. 8*b* shows for Example 2 the distribution of the temperature of dried compressed air around all channels in the housing of the heat exchanger, measured at positions a to i. This distribution is shown as a solid line with triangular symbols. The setpoint of 3.0° C. is represented by a long-dashed line.

In Example 3, in the comparative example, the inlet collector of the heat exchanger is replaced by an inlet collector with first flow-rate distribution means according to the invention as shown in FIG. 4*a*-4*c*, and an intermediate collector according to the invention as shown in FIG. 6 is incorporated in the heat exchanger.

FIG. 8*c* shows for example 3 the distribution of the temperature of dried compressed air around all channels in the housing of the heat exchanger, measured at positions a to i. This distribution is shown as a solid line with triangular symbols. The setpoint of 3.0° C. is represented by a long-dashed line.

In Example 4, in the comparative example, the inlet collector of the heat exchanger is replaced by an inlet collector with first flow-rate distribution means according to the invention as shown in FIG. 4*a*-4*c*, the outlet collector is replaced by an outlet collector according to the invention as shown in FIG. 5*a*-5*c*, and an intermediate collector according to the invention as shown in FIG. 6 is incorporated in the heat exchanger.

FIG. 8*d* shows, for Example 4, the distribution of the temperature of dried compressed air around all channels in the housing of the heat exchanger, measured at positions a to i. This distribution is shown as a solid line with triangular symbols. The setpoint of 3.0° C. is represented by a long-dashed line.

This leads to the following measurement results at an airflow rate of 1010 l/s for the various examples 1 to 4:

| Example | 1 | 2 | 3 | 4 |
|---|---|---|---|---|
| LAT left-LAT right(° C.) | 3.0-3.1 | 3.0-3.1 | 3.1-3.3 | 3.3-3.4 |
| PDP (° C.) | 3.2 | 2.8 | 3.1 | 3.7 |
| Tevap (° C.) | −1.7 | −1.6 | −0.9 | −0.9 |

Consequently, the proximity between the dew pressure and the evaporation temperature in examples 1 to 4 is equal to 4.9° C., 4.4° C., 4.0° C. and 4.6° C. respectively.

The maximum value for the temperature difference 'ΔTair' for Examples 1 to 4 is equal to 4.4° C., 4.3° C., 3.2° C. and 3.1° C. respectively.

Example 5 and 6

A refrigeration dryer with the heat exchanger according to Example 4 is also tested at low airflow rates: an airflow rate of 750 l/s in Example 5 and an airflow rate of 500 l/s in Example 6.

FIG. 9 shows for Examples 5 and 6 the distribution of the temperature of dried compressed air around all channels in the housing of the heat exchanger, measured at positions a to i.

The setpoint of 3.0° C. is shown in FIG. 9 by a long-dashed line. The distribution of the temperature of dried compressed air is shown as

- a solid line with circular symbols for an ambient airflow rate of 1010 l/s;
- a short-dashed line with square symbols for an ambient airflow rate of 750 l/s; and
- a dotted line with rhombic symbols for an ambient airflow rate of 500 l/s.

Measurement results for Examples 5 and 6 are summarized in the table below:

| Example | 4 | 5 | 6 |
|---|---|---|---|
| LAT left-LAT right(° C.) | 3.3-3.4 | 3.2-3.3 | 1.9-2.1 |
| PDP (° C.) | 3.7 | 3.7 | 2.4 |
| Tevap (° C.) | −0.9 | 0.9 | 0.3 |
| Proximity (° C.) | 4.6 | 2.8 | 2.1 |

When the proximities in Examples 4 to 6 are compared with the proximities in the comparative example, it can be concluded that for the same airflow rate the proximities in Examples 4 to 6 are smaller than those in the comparative example. Furthermore, a decrease in the proximity at the low airflow rates in Examples 5 and 6 with respect to the proximity in example 4 is greater than the decrease that occurs at the low airflow rates in the comparative example.

The smaller the proximity, the greater the heat transfer between the initially two-phase cooling agent and the compressed air, and the more energy-efficient the refrigeration dryer operates as a result.

The improved smaller proximities in Examples 4 to 6 can be explained by a more uniform distribution of the temperatures of dried compressed air around all channels in the housing of the heat exchanger, as a result of which said temperatures can be controlled closer to the setpoint of 3.0° C. without running the risk of one of these temperatures becoming too low so that the heat exchanger would freeze up.

The maximum value for the temperature difference 'ΔTair' for Examples 5 to 6 is equal to 1.8° C. and 1.1° C. respectively.

The present invention is by no means limited to the embodiments described as examples and shown in the figures, but a heat exchanger according to the invention, an inlet collector and/or an outlet collector for such a heat exchanger, or a refrigeration dryer provided with such a heat exchanger may be implemented in all kinds of variants and/or dimensions without going beyond the scope of protection of the invention according to the claims.

The invention claimed is:

1. A heat exchanger for exchanging heat between two fluids, respectively a first initially two-phase fluid and a second fluid, the heat exchanger comprising:

a housing (3) that encloses an internal cavity;

a set of channels (12), where each one of the channels (12) in said set passes through the internal cavity of the housing (3);

an inlet collector (4) comprising a wall with an inlet (5) for the first initially two-phase fluid, which inlet (5) is in fluid communication with an inlet collector chamber (9) within the inlet collector (4), where both the inlet (5) and the inlet collector chamber (9) are symmetrical in planes of symmetry according to a first plane of symmetry and a second plane of symmetry intersecting said first plane of symmetry, the inlet collector (4) being hermetically connected to the housing (3) on one side of the inlet collector (4) disposed opposite the wall with the inlet (5), and where the inlet collector chamber (9) comprises first flow-rate distribution means (10) configured to distribute a first initially two-phase fluid flow originating from the inlet (5) evenly across the set of channels (12); and an outlet collector (6) comprising a wall with an outlet (7) for the first initially two-phase fluid, which outlet (7) is in fluid communication with an outlet collector chamber (20) in the outlet collector (6), where said outlet collector (6) is hermetically connected to the housing (3) on a side of the outlet collector (6) disposed opposite the wall with the outlet (7), where all inlet orifices (11) of the set of channels (12) are in fluid communication with the inlet collector chamber (9) and all outlet orifices (14) of the set of channels (12) are in fluid communication with the outet collector chamber (20), where the inlet orifices (11) of the channels (12) are symmetrically arranged with respect to each other according to the first plane of symmetry and the second plane of symmetry, wherein the first flow-rate distribution means (10) includes a single body (15) that comprises two flow-conducting surfaces (16), which two flow-conducting surfaces are symmetrical with respect to each other according to the first plane of symmetry and the second plane of symmetry, and which two flow-conducting surfaces (16), as seen from the inlet (5), are inclined downward in a first direction perpendicular to the first plane of symmetry and/or in a second direction perpendicular to the second plane of symmetry, whereby a cross section of the first flow-rate distribution means (10), considered in a plane equal or parallel to the first plane of symmetry or the second plane of symmetry, comprises a substantially full figure formed by the two flow-conducting surfaces (16) and a substantially straight base, the flow-conducting surfaces (16) each being connected by the base at an end situated furthest away from the inlet (5).

2. The heat exchanger according to claim 1, wherein the inlet orifices (11) of the set of channels (12) are arranged in a straight line according to the first direction and symmetrically with respect to each other according to the first plane of symmetry.

3. The heat exchanger according to claim 2, wherein the two flow-conducting surfaces (16) as seen from the inlet (5) only incline downward direction.

4. The heat exchanger according to claim 1, wherein the single body of the first flow-rate distribution means (10) contains a through hole (17) with an axis (18) according to a straight line common to the first plane of symmetry and the second plane of symmetry.

5. The heat exchanger according to claim 1, wherein the inlet collector chamber (9) is bounded by a wall of the inlet collector (4), which wall has a surface (19) facing the inlet collector chamber (9) that stands opposite and substantially parallel to the two flow-conducting surfaces (16).

6. The heat exchanger according to claim 1, wherein each one of the channels (12) in the set of channels (12) has a constant diameter D; and that in a direction common to the first plane of symmetry and the second plane of symmetry, the inlet collector chamber (9) is smaller than 2.0 times the diameter D.

7. The heat exchanger according to claim 1, wherein the cross section of the first flow-rate distribution means (10), considered in a plane equal or parallel to the first plane of symmetry or the second plane of symmetry, comprises a substantially full and substantially isosceles triangle of which the sides of equal length are formed by the two flow-conducting surfaces (16) or comprises a substantially full and substantially isosceles trapezium of which the sides of equal length are formed by the two flow-conducting surfaces (16).

8. The heat exchanger according to claim 1, wherein in the first direction and/or in the second direction a dimension of the inlet (5) is approximately equal to or greater than a dimension of the first flow-rate distribution means (10).

9. The heat exchanger according to claim 1, wherein the outlet collector chamber (20) has a substantially cuboid shape, where the outlet orifices (14) of the channels (12) are in fluid communication with the outlet collector chamber (20) on a first side of the outlet collector chamber (20), and where the outlet (7) is in fluid communication with the outlet collector chamber (20) on a second side of the outlet collector chamber (20) opposite the aforementioned first side of the outlet collector chamber (20).

10. The heat exchanger according to claim 9, wherein each one of the channels (12) in the set of channels (12) has a constant diameter D; and that a perpendicular distance between the aforementioned first side and the aforementioned second side is at least 1.0 times the diameter D.

11. The heat exchanger according to claim 1, wherein the heat exchanger further comprises an intermediate collector (8) between the inlet collector (4) and the outlet collector (6), which intermediate collector (8) is provided with second flow-rate distribution means (21) configured such that a flow of the first initially two-phase fluid in a channel in the set of channels (12) can be at least partially diverted from this channel to and into another channel of the set of channels (12).

12. A refrigeration dryer for cooling and dehumidifying a gas compressed in a compressor installation, which refrigeration dryer comprises a heat exchanger according to claim 1.

13. A method for manufacturing a heat exchanger for exchanging heat between two fluids, a first initially two-phase fluid and a second fluid, respectively, where the following components are integrated into the heat exchanger:

a housing (3) that encloses an internal cavity;

a set of channels (12), where each one of the channels (12) in said set passes through the internal cavity of the housing (3);

an inlet collector (4) comprising a wall with an inlet (5) for the first initially two-phase fluid, which inlet (5) is in fluid communication with an inlet collector chamber (9) within the inlet collector (4), where both the inlet (5) and the inlet collector chamber (9) are symmetrical in planes of symmetry according to a first plane of symmetry and a second plane of symmetry intersecting said first plane of symmetry, the inlet collector (4) being hermetically connected to the housing (3) on one side of the inlet collector (4) disposed opposite the wall with the inlet (5), and where the inlet collector chamber (9) comprises first flow-rate distribution means (10) to distribute a first initially two-phase fluid flow originating from the inlet (5) evenly across the set of channels (12); and an outlet collector (6) comprising a wall with an outlet (7) for the first initially two-phase fluid, which outlet (7) is in fluid communication with an outlet collector chamber (20) in the outlet collector (6), where said outlet collector (6) is hermetically connected to the housing (3) on a side of the outlet collector (6) disposed opposite the wall with the outlet (7), where all inlet orifices (11) of the set of channels (12) are connected in fluid connection to the inlet collector chamber (9) and all outlet orifices (14) of the set of channels (12) are connected in fluid connection to the outlet collector chamber (20), where the inlet orifices (11) of the channels (12) are symmetrically arranged with respect to each other according to the first plane of symmetry and the second plane of symmetry, wherein the first flow-rate distribution means (10) includes a single body (15) comprising two flow-conducting surfaces (16) which are symmetrical with respect to each other according to the first plane of symmetry and the second plane of symmetry, and which, as seen from the inlet (5), incline downward in a first direction perpendicular to the first plane of symmetry and/or in a second direction perpendicular to the second plane of symmetry, whereby a cross section of the first flow-rate distribution means (10), considered in a plane equal or parallel to the first plane of symmetry or the second plane of symmetry, comprises a substantially full figure formed by the two flow-conducting surfaces (16) and a substantially straight base, the flow-conducting surfaces (16) each being connected by the base at an end situated furthest away from the inlet (5).

14. The method according to claim 13, wherein the inlet (5) is implemented with, in the first direction and/or in the second direction, a dimension which is equal to or greater than a dimension of the first flow-rate distribution means (10).

15. The method according to claim 14, wherein the inlet collector (4) is manufactured integrally with the first flow-rate distribution means (10) by means of a machining technique.

* * * * *